US008573598B2

(12) United States Patent
Shover et al.

(10) Patent No.: US 8,573,598 B2
(45) Date of Patent: Nov. 5, 2013

(54) SOOTBLOWER ISOLATION WALL BOX

(75) Inventors: Stephen L. Shover, Millersport, OH (US); Tony F. Habib, Lancaster, OH (US); Dennis K. McDonald, Massillon, OH (US)

(73) Assignee: Diamond Power International, Inc., Lancaster, OH (US)

( * ) Notice: Subject to any disclaimer, the term of this patent is extended or adjusted under 35 U.S.C. 154(b) by 1084 days.

(21) Appl. No.: 12/561,488

(22) Filed: Sep. 17, 2009

(65) Prior Publication Data

US 2011/0061611 A1 Mar. 17, 2011

(51) Int. Cl.
*F16L 17/02* (2006.01)

(52) U.S. Cl.
USPC ..... 277/314; 122/379; 122/390

(58) Field of Classification Search
USPC ..... 122/390.379; 277/314
See application file for complete search history.

(56) References Cited

U.S. PATENT DOCUMENTS

| | | | | |
|---|---|---|---|---|
| 3,972,537 | A * | 8/1976 | McClelland | 279/4.01 |
| 4,924,817 | A * | 5/1990 | Seelen | 122/379 |
| 5,048,636 | A | 9/1991 | Roehrs | |
| 6,877,712 | B2 * | 4/2005 | Wiedemann | 251/1.3 |
| 7,814,979 | B2 * | 10/2010 | Springett et al. | 166/298 |
| 2007/0137866 | A1 * | 6/2007 | Ravensbergen et al. | 166/384 |

* cited by examiner

*Primary Examiner* — Kang Hu
*Assistant Examiner* — John Bargero
(74) *Attorney, Agent, or Firm* — Brinks Hofer Gilson & Lione

(57) ABSTRACT

A sootblower isolation wall box provided for sealing the wall box opening of a large scale boiler to provide sootblower lance tube access to the boiler. The wall box assembly includes a clamping seal assembly having radial sealing segments which are individually actuated. Applying fluid pressure to actuating cylinders causes the seal segments to be clamped against the outer circumference of the sootblower lance tube. During cleaning cycles, the segments are actuated to provide a radial clearance with the lance tube. Preferably, the clamping seal assembly is used in connection with another seal assembly which is relied upon to provide sealing during the cleaning steps. In a preferred embodiment, the additional seal assembly is in the form of a labyrinth-type seal assembly.

16 Claims, 4 Drawing Sheets

SOOTBLOWER ISOLATION WALL BOX

FIELD OF THE INVENTION

The present invention relates generally to a wall box for a retracting sootblower for sealing a cleaning port opening in the wall of a large scale boiler. More particularly, the present invention is directed to a sootblower wall box constructed to provide enhanced sealing of the wall box opening when the sootblower is in a non-operating, retracted position.

BACKGROUND AND SUMMARY OF THE INVENTION

To optimize the thermal efficiency of large scale fossil fuel burning heat exchangers or boilers, it is necessary to periodically remove deposits such as soot, slag and fly ash from their interior heat exchanging surfaces. Typically, a number of cleaning device such as those known as sootblowers, are mounted to the exterior of the boiler. One type of sootblower has a lance tube which is inserted periodically into the boiler through a cleaning port located in the boiler wall. Positioned on the forward end of the lance are one or more cleaning nozzles. The nozzle discharges a pressurized cleaning medium, such as air, water steam or other solutions. The high pressure cleaning medium contacts deposits of soot, slag and fly ash and causes them to be dislodged from the internal structures of the boiler.

Conventional wall box assemblies serve a number of purposes. One purpose being to provide a support structure for the previously mentioned cleaning lances. Without a sealing wall box, during cleaning, combustion by-products would escape to the exterior of the boiler or air could enter the boiler through the gap between the cleaning lance and the cleaning port. Controlling leakage through the boiler access ports poses a number of significant design challenges. There is a requirement of sealing the opening to prevent boiler gases from leaking outside the boiler. Conversely, in many applications of negative pressure operating boilers, there is a desire not to admit fresh air in an uncontrolled manner through sootblower wall ports. Oxy-fuel boilers use a mixture of flue gas and oxygen as an oxidant instead of air, and therefore the uncontrolled introduction of air is undesirable. The wall box for a lance port must also provide a good seal against the lance tube during its operation for the reasons mentioned previously.

Some existing wall box assembly designs incorporate two pressurized air flow circuits and include a sealing air chamber and an aspirating air chamber. Both chambers are supplied with pressurized air and provide air to the wall box at a pressure greater than the internal operating pressure of the boiler. When the sootblower lance is inserted through the wall box for cleaning, positive pressure sealing air is provided to the wall box assembly. Once the cleaning lance is fully retracted, aspirating air is directed toward the interior of the heat exchanger through an annular array of ports. The orientation of the aspirating ports, along with the increased pressure of the aspirating air, restricts the outflow of combustion by-products from the cleaning port during normal operation of the boiler. Mechanical closure devices may be used to plug the wall ports between operating cycles of the sootblower.

The requirement of a wall box to have sealing airflow imposes efficiency limitations by requiring a constant source of compressed air. Purge airflow also imposes cost due to the equipment and plumbing required and gives rise to a source of system failure. It is desirable to reduce the reliance on sealing air while meeting acceptable sealing performance requirements for the wall box.

SUMMARY OF THE INVENTION

The above design objectives are achieved through providing a sootblower isolation wall box in accordance with the present invention. In the preferred embodiments, the wall box includes a clamping seal assembly having movable sealing elements which are actuated through fluid operated cylinders or other actuation devices to clamp against the lance tube in the manner similar to a drill motor or lathe chuck. In the preferred embodiments, the clamping seal assembly is used in conjunction with another seal assembly such as a labyrinth-type ring seal assembly which may be of conventional design. In operation, during the cleaning cycle, the clamping seal assembly is actuated to disengage from the lance tube which can then be moved into and out of the boiler. During the cleaning cycle, the labyrinth-type seal or other seal assembly is primarily relied upon to provide wall box sealing. Once the lance tube reaches a retracted and parked position, the clamping seal assembly is actuated to clamp against the lance tube to provide enhanced sealing. In preferred embodiments, continuous purge or sealing air flow is not required once the lance tube is in the parked position due to the high level of sealing provided by the clamping seal assembly.

Additional benefits and advantages of the present invention will become apparent to those skilled in the art to which the invention relates from the subsequent description of the preferred embodiment and the appended claims, taken in conjunction with the accompanying drawings.

DETAILED DESCRIPTION OF THE PREFERRED EMBODIMENT

Figure 1:
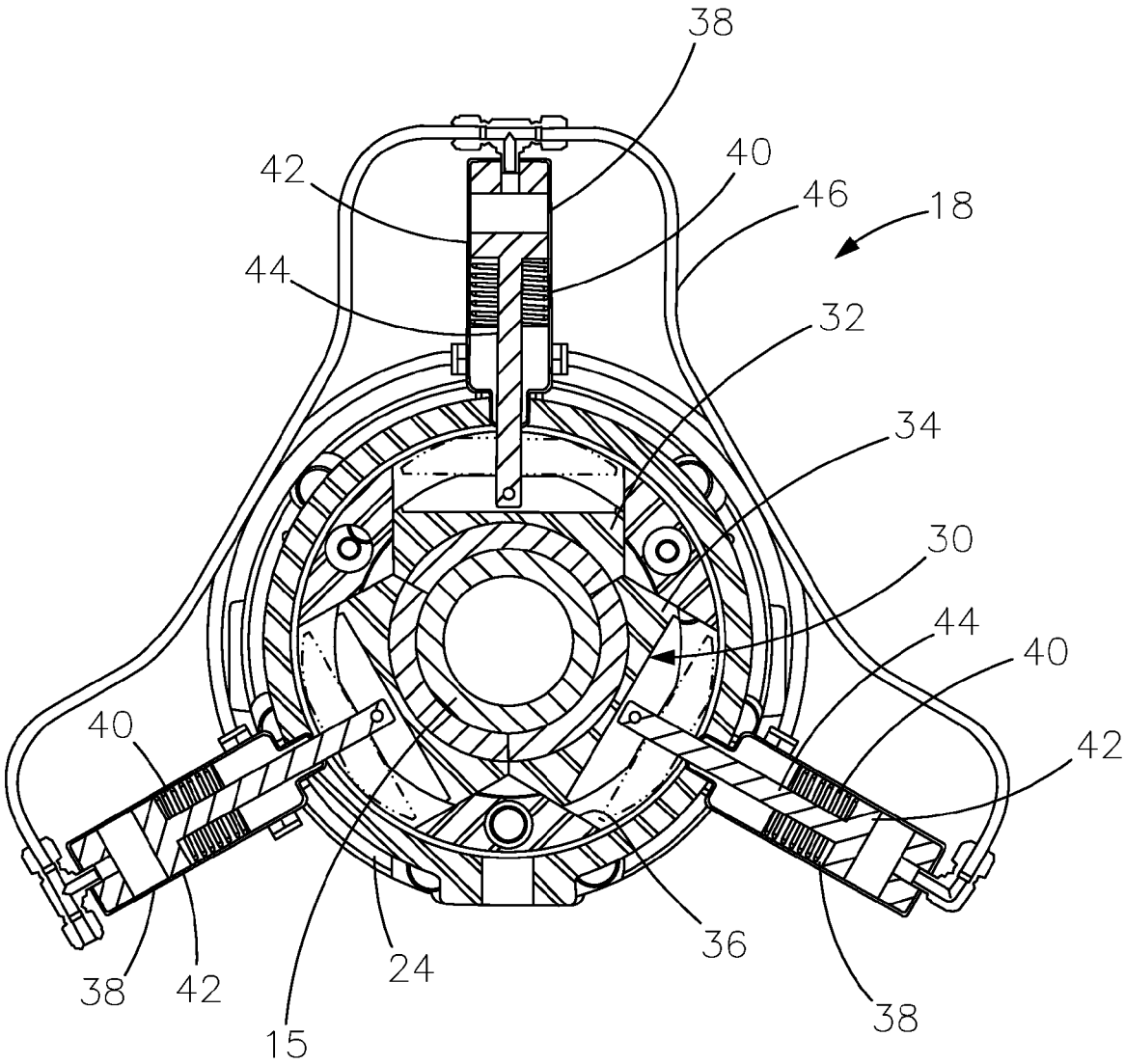
FIG. 1 is a traverse cross-sectional view of a sootblower isolation wall box assembly in accordance with a first embodiment of the present invention particularly showing the clamping seal assembly.
Figure 2:
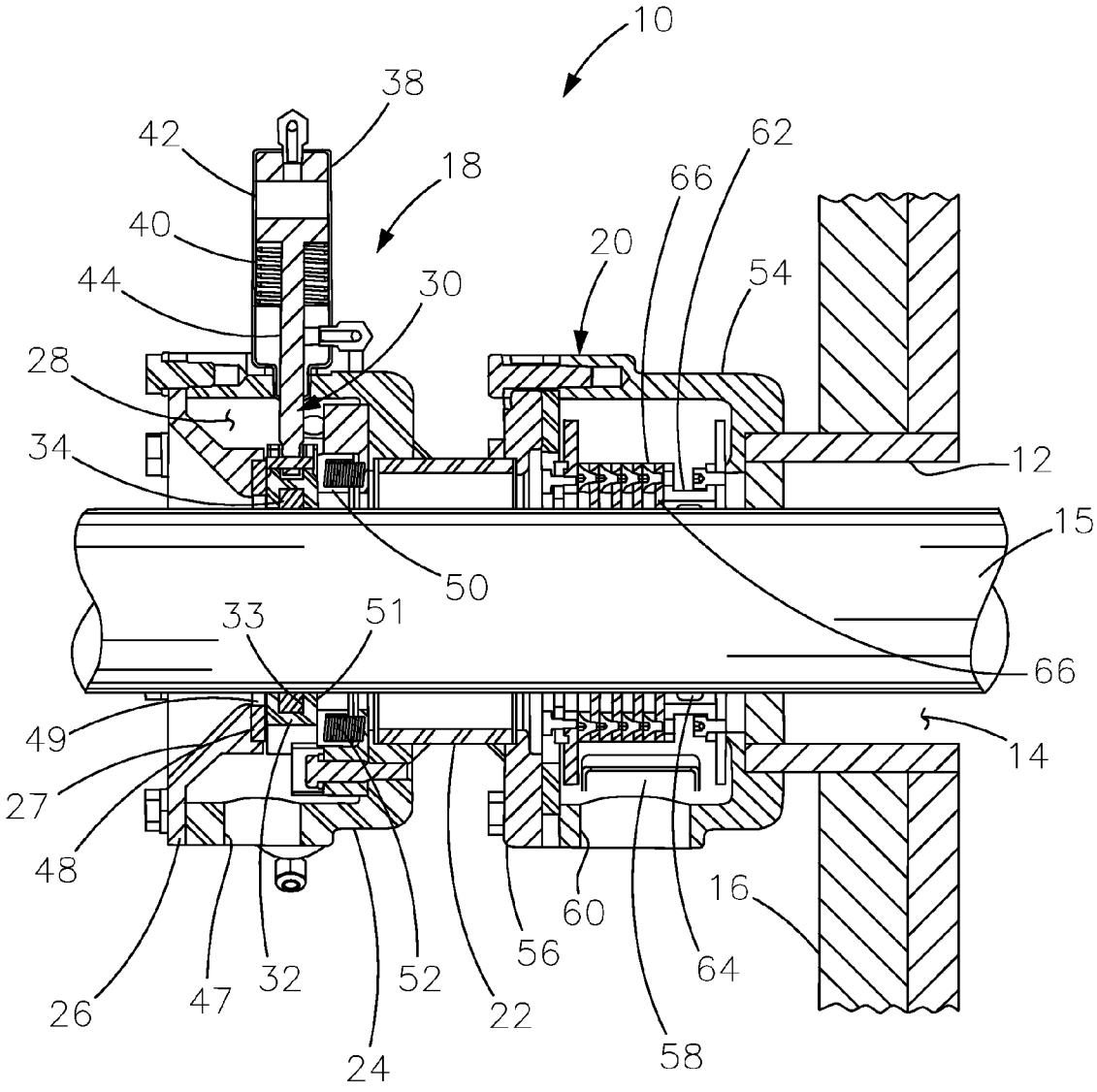
FIG. 2 is a longitudinal cross-sectional view of the sootblower isolation wall box assembly in accordance with a first embodiment of the present invention showing the clamping seal assembly with the labyrinth seal assembly shown with a lance tube in position within the wall box assembly.

With particular reference to FIGS. 1 and 2, isolation wall box 10 is used with a retractable type sootblower having a retracting lance tube through which a fluid cleaning medium flows. As particularly shown in FIG. 2, the assembly 10 is mounted on the exterior of a large scale boiler upon a sleeve pipe 12 extending through a cleaning port 14 in a boiler wall 16. Wall box assembly 10 allows lance tube 15 to move into and out of the boiler through cleaning port 14.

As best shown in FIG. 2, wall box assembly 10 generally includes clamping seal assembly 18 and an additional seal assembly, shown here as labyrinth seal assembly 20, both for sealing against gas leakage around lance tube 15. As shown, labyrinth seal assembly 20 is mounted directly onto sleeve pipe 12, whereas an extension pipe 22 joins and connects together the seal assemblies 18 and 20.

Clamping seal assembly 18 includes housing 24 in the form of an annular open-ended cup with the open end enclosed by lead-in funnel plate 26 which includes a tapered surface 27 to aid in guiding lance tube 15. Once the funnel plate 26 is affixed to housing 24, an annular internal cavity 28 is formed which provides an area for sealing airflow, as explained in more detail in the following description. Port 47 is provided to allow an external source of high pressure air to be supplied to annular internal cavity 28.

Referring particularly to FIG. 1, clamping seal assembly 18 is shown includes a series of, preferably three, movable seal assemblies 30. Each of the movable seal assemblies 30 is generally identical and therefore a description of one will suffice for each of them. Each seal assembly 30 has a seal shoe 32 in the form of a partial arc segment and includes an open internal groove or channel 33 which receives seal element 34. Seal shoes 32 are able to be articulated and moved in a radial direction and are guided by engagement with surfaces of guide blocks 36. Actuating cylinder 38 is provided which is preferably operated by hydraulic or pneumatic pressure. In a preferred embodiment, cylinders 38 would be pneumatically operated, although hydraulic operation could be used, as well as other forms of actuators, such as electric motor or solenoid types. As illustrated, actuating cylinders 38 include an internal compression spring 40 which urges piston 42 having piston rod 44 to a radially outward extending position. Piston rod 44 is pinned to seal shoe 32 via a rivet, pin, or other fastener. Three of the seal assemblies 30 are arranged with their seal elements 34 in equal angular arc segments arranged around the outside circumferential surface of lance tube 15. Fluid tubing 46 is used to apply air or other fluid pressure to cylinders 38.

FIGS. 1 and 2 illustrate the position of the components of clamping seal assembly 18 when the air or other fluid pressure is applied to actuating cylinders 38. In that condition, the spring force produced by springs 40 is overcome by applied fluid pressure and the pistons 42 and piston rods 44 are urged to a radially inward, sealing or clamping position. This motion presses seal elements 34 against the outer circumference of lance tube 15. In this condition, seal elements 34 abut together and cooperate to provide a generally continuous circumferential seal against the outside surface of lance tube 15. In another operating condition, fluid pressure to actuating cylinders 38 is relieved and the force exerted by springs 40 causes the pistons 42 and piston rods 44 to retract, pulling seal elements 34 away from sealing engagement with the outer circumference of lance tube 15. In the retracted position, extension and retraction movement of lance tube 15 is not restricted.

As best shown by FIG. 2, seal shoes 32 form two radial face surfaces 49 and 51. One radial face surface 49 bears against seal ring 48 which is maintained in position within an internal counter bore of lead-in funnel plate 26. Seal plate 50 acts against the opposite radial face surface 51 of the seal shoe 32 and is biased into contact with the seal shoe through the use of coil springs 52. The force exerted by coil springs 52 clamps seal shoe 32 between seal ring 48 and seal plate 50 which provides a seal against gas leakage when the seal shoes 32 are in sealing contact with lance tube 15.

An additional seal assembly is preferably used in conjunction with clamping seal assembly 18, shown here and described as labyrinth seal assembly 20. Labyrinth seal assembly 20 includes an open ended cup shaped annular housing 54. End plate 56 is affixed to the open end of housing 54 to enclose and form internal annular chamber 58. Port 60 provides for a source of sealing airflow to annular chamber 58. Within housing 54 is disposed collar 62 having a number of radial holes or ports 64 for providing purge airflow. A series of stacked seal plates 66 is provided within annular chamber 58 and each has a circular inner bore having a diameter which provides a small radial clearance with the outside diameter surface of lance tube 15. Labyrinth seal assembly 20 is of generally conventional construction. By providing a multiplicity of seal plates 66, the pressure difference (and leakage) between adjacent plates can be reduced to provide for sealing leakage control in the manner of a labyrinth-type seal unit.

Operation of wall box assembly 10 will now be explained with particular reference to FIG. 2. FIG. 2 illustrates lance tube 15 in a retracted position which corresponds to its position between cleaning cycles. In this condition, fluid pressure is applied to cylinders 38 such that sealing shoes 32 and seal elements 34 are clamped into engagement with the outer circumference of lance tube 15. This sealing position minimizes leakage occurring across the wall box assembly 10 between the inside and outside of the boiler. Due to the positive clamping engagement with the lance tube, it may not be necessary to apply sealing airflow to either clamping seal assembly 18 or labyrinth seal assembly 20 when the assembly 10 is in this sealing condition.

When a sootblower cleaning cycle is to be performed, the fluid pressure applied to cylinders 38 is relieved, allowing the seal shoes 32 to retract to a released position under the influence of actuating cylinder springs 40, thus providing a radial clearance between the outer circumference of the lance tube 15 and seal elements 34. After the cylinder retraction occurs, the sootblower may be operated, causing lance tube 15 to be inserted inside the boiler for cleaning purposes. During the longitudinal motion of lance tube 15, labyrinth seal assembly 20 provides sealing and is supplied with seal gas flow into port 60 during the cleaning step. The seal gas may be air, but in some applications such as oxy-fuel boilers, nitrogen may be preferred. Also, in some applications, no seal gas would be supplied to labyrinth seal assembly 70 and the seal assembly would operate in a passive mode, serving to reduce the amount of flue gas leakage from the boiler. Once the lance tube 15 again reaches its retracted and parked position, withdrawn from the boiler, fluid pressure may again be applied to cylinders 38 to move the shoes 32 to the sealing position to provide the positive sealing engagement with the lance tube.

Labyrinth seal assembly 20 provides an additional benefit when used in conjunction with clamping seal assembly 18. Upon retraction of lance tube 15, seal plates 66 scrape off and clean the outside surface of lance tube 15. This action improves the service life of seal elements 34 and enables them to seal more effectively against a cleaned lance tube. For these reasons, labyrinth seal assembly 20 is best positioned closer to the cleaning port 14 than clamping seal assembly 18.

Figure 3:
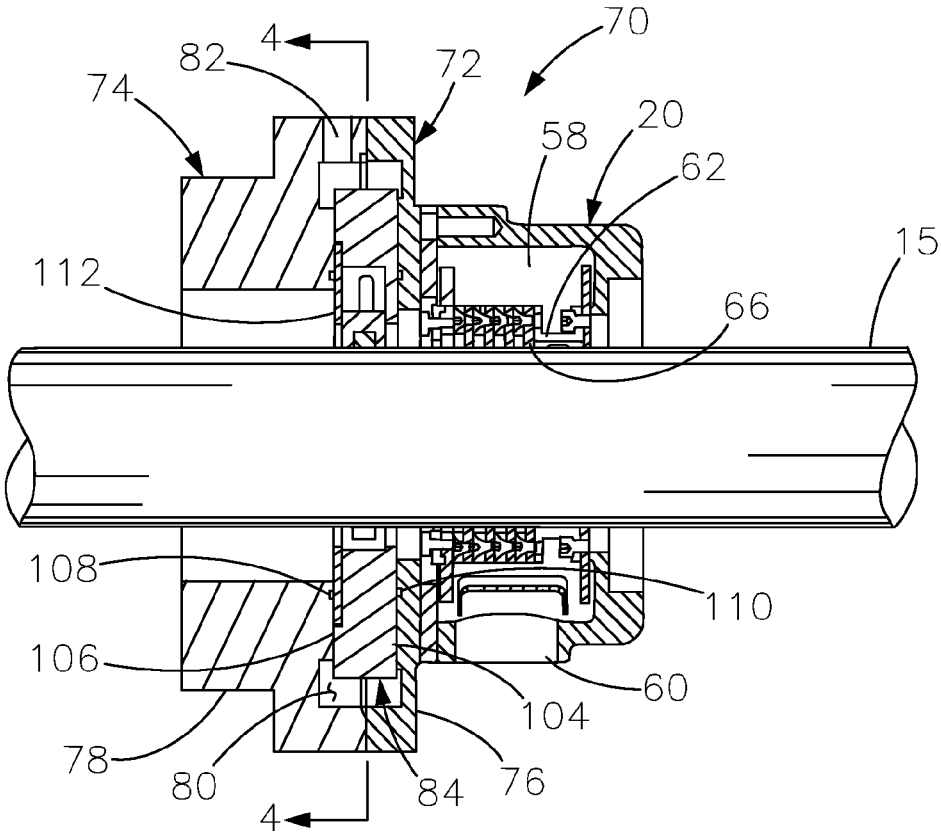
FIG. 3 is longitudinal cross-sectional view of a sootblower isolation wall box assembly in accordance with the second embodiment of the present invention.
Figure 4:
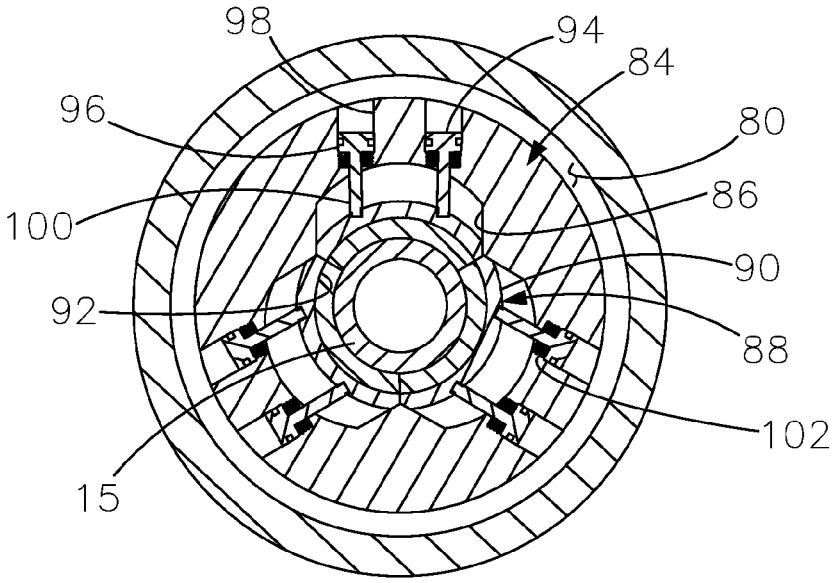
FIG. 4 is a transverse cross-sectional view of the isolation wall box assembly illustrated in FIG. 3.
Figure 5:
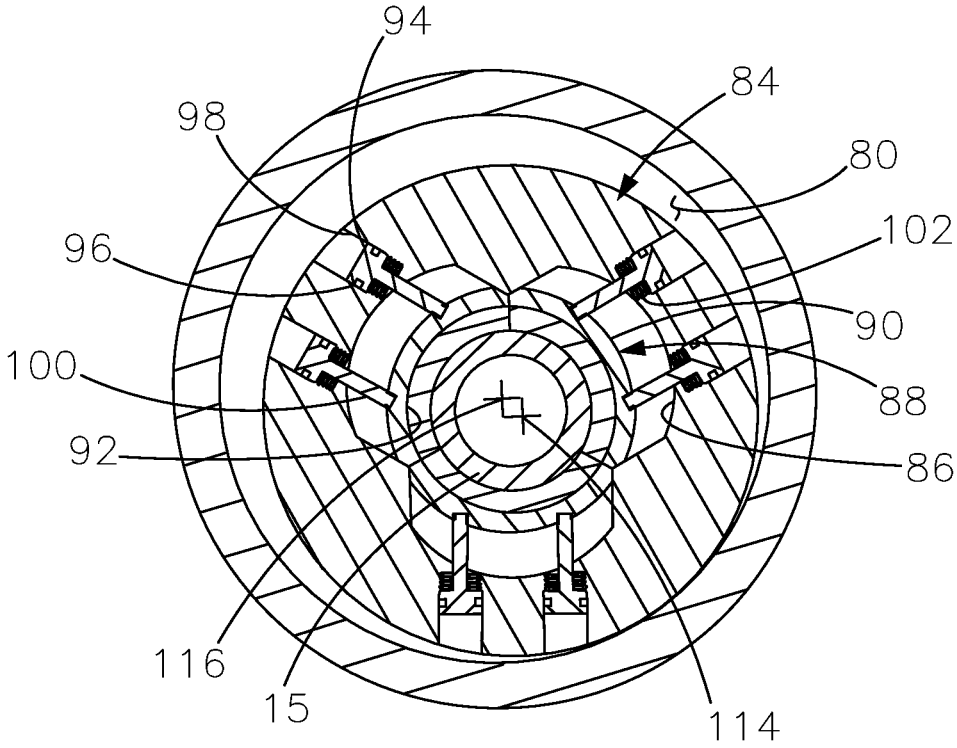
FIG. 5 is a transverse cross-sectional view similar to FIG. 4 but showing the jaw plate of the clamping seal assembly positioned in an off-center clamping position.

FIGS. 3, 4, and 5 illustrate a sootblower isolation wall box assembly in accordance with a second embodiment of the invention which is generally designated by reference number 70. Wall box assembly 70 employs a number of components identical to that described in connection with wall box assembly 10 in accordance with the first embodiment of this invention. These common elements are previously described and identified by common reference numbers. FIG. 3 illustrates wall box assembly 70 apart from its installation into a sootblower application. As such, FIG. 3 does not illustrate attachment to sleeve pipe 12. Wall box assembly 70 differs from the first embodiment in the design of clamping seal assembly 72 which uses the primary concepts of the first embodiment, but has additional features. Wall box assembly 70 employs a secondary seal assembly in the form of labyrinth seal assembly 20 which is identical to the first embodiment. In this case, clamping seal assembly 72 includes a housing 74 which is mounted directly to labyrinth seal assembly 20 and thus the extension pipe 22 of the first embodiment is eliminated. Wall box assembly 70 includes an additional feature of permitting clamping seal assembly 72 to "self center", allowing the center position formed by the clamping elements to locate to the longitudinal center position of lance tube 15. This feature will be described in greater detail below.

Clamping assembly housing 74 is formed by two stacked plates 76 and 78 which form annular chamber 80 which communicates with pressure port 82. Housing 74 is mounted rigidly to labyrinth seal assembly 20. Annular jaw plate 84 is trapped within annular chamber 80. Details of jaw plate 84 are best described with reference to FIG. 4. As illustrated, jaw plate 84 has a circular outer circumference and includes a series of three cut-outs 86 which accommodate a series of three movable seal assemblies 88. Each movable seal assembly 88 includes a seal shoe 90 which mounts a seal element 92. As illustrated, cut-outs 86 support and allow movable seal assembly 88 to move in a radial direction from the clamping sealing position shown in FIG. 4 to a displaced radially outer released position within the cut-out. Actuating each movable seal assembly 88 is a pair of actuating pistons 94. In the embodiment illustrated, two actuating pistons 94 are provided for each movable seal assembly 88. In alternate embodiments, a single piston could be used, and any one or more piston could have other shapes such as oval cross-sections could be used. Actuating pistons 94 include a piston head 96 which fits within radial bores 98 cut into jaw plate 84. Piston rods 100 connect with and are preferably pinned to seal shoes 90. An internal coil spring 102 is positioned to radially bias piston head 96 to a radially outer released position.

Now again referring to FIG. 3, jaw plate faces 104 and 106 are clamped against opposing surfaces formed by housing plates 76 and 78, respectively. A pair of ring seals 108 and 110 are provided for pressure sealing. To enable convenient assembly, annular cover plate 112 is provided to allow access to internal components of jaw plate 84.

As mentioned previously, the primary benefit of wall box assembly 70 as compared with the first embodiment, is the ability of clamping seal assembly 72 to adjust its center position to match that of the lance tube which it engages when in the sealing position. Since the labyrinth seal plates 62 form a small clearance with the outside diameter of lance tube 15, they define a center position for lance tube 15. It is desirable to allow the clamping seal assembly 72 to locate to that position rather than placing forces on the lance tube 15 which would tend to move it from its position within labyrinth seal assembly 20. If the clamping seal assembly 18 or 72 when it is clamped, forces lance tube 15 against seal plates 66, excessive wear can occur, which reduces the sealing efficiency and life span of seal assembly 20.

Many times on long travel blowers, the lance tube is intentionally off set from the center line of the wall box (deflection correction). This allows the lance tube 15 to move through a straighter arc into the boiler and is done to compensate for the weight and sagging of the lance tube. The labyrinth seal plates 66 are designed to follow the lance tube 15 and are self centering so excessive wear will not occur. If the wall box assembly 10 did not have the self centering feature, it would require custom placement on each blower to match where the natural center line of the lance tube 15 would be after deflection correction has been set.

In operation, when it is desired to actuate clamping seal assembly 72 to seal against lance tube 15, fluid pressure, preferably air, is applied to pressure port 82. The pressurized fluid flows into annular chamber 80 and surrounds jaw plate 84 in the radial clearance provided between the outside diameter of jaw plate 84 and the inside diameter of annular chamber 80. The fluid pressure enters radial bores 98 and applies fluid pressure to piston heads 96. A pressure differential across actuating pistons 94 occurs because the applied fluid pressure does not act on the radially inward surfaces of the actuating pistons 94 due to the sealing provided by rings 108 and 110. If fluid pressure of a predetermined level is applied, the spring bias forces of coil springs 102 are overcome and the seal assemblies 88 are moved to their radially inward sealing positions, clamping against lance tube 15. Wall box assembly 70 operates like assembly 10 with regard to the periodic clamping and unclamping during actuation of an associated sootblower with the clamping seal assemblies 18 and 72 being actuated to clamp against the lance tube 15 when it is in the retracted and parked position.

In the embodiment shown by FIGS. 3, 4, and 5, due to the existence of a radial clearance around jaw plate 84, the jaw plate can move to "find" the position of lance tube 15. As illustrated in FIG. 5, the jaw plate 84 can move to an off-center position with respect to housing 74 if that is needed in order to locate to the position of lance tube 15. Preferably, the clamping force exerted by housing plates 76 and 78 against jaw plate 84 provide some friction to keep the jaw plate from moving without constraint, but would permit them to move to locate to the lance tube position as described previously. As shown in FIG. 5, the position of the longitudinal axis of lance tube 15, designated by reference number 114, is displaced from the center position 116, of housing 74. Within the radial clearance provided between jaw plate 84 and housing annular chamber 80, a range of possible off-center positions (displacements of centers 114 and 116) are possible.

Although both sootblower isolation wall box assemblies 10 and 70 are illustrated and described used with a secondary seal in the form of labyrinth seal assembly 20, it should be understood that other forms of secondary seal assemblies may be used with clamping seal assemblies 18 and 72 and, in some applications, it may be unnecessary to provide a secondary seal assembly, and consequently the clamping seal assemblies 18 and 72 may be used by themselves.

While the above description constitutes the preferred embodiment of the present invention, it will be appreciated that the invention is susceptible to modification, variation and change without departing from the proper scope and fair meaning of the accompanying claims.

The invention claimed is:

1. A wall box assembly for a sootblower of the type having a lance tube for cleaning internal surfaces of a combustion device, and wherein a fluid cleaning medium flows through the lance tube during a cleaning cycle and is ejected from the lance tube within the combustion device, the lance tube passing through the wall box assembly and being retractable into and withdrawn from the combustion device, the wall box assembly comprising:

a clamping seal assembly having a plurality of movable seal assemblies, the movable seal assemblies each having a seal element movable in a radial direction relative to the lance tube, the seal elements engageable with the outside surface of the lance tube in a sealing position and withdrawn from sealing contact with the outside surface of the lance tube in a released position, the seal elements movable between the sealing and released positions through the action of an actuator, wherein the clamping seal assembly includes a housing forming an internal chamber with a cylindrical wall and a circular jaw plate, the jaw plate mounted within the internal chamber with a clearance gap between the jaw plate and the cylindrical wall, the actuator being formed of a plurality of pistons retained by the jaw plate and each piston coupled with one of the seal elements and configured to move the one of the seal elements radially with respect to the jaw plate, and the jaw plate being radially movable within the internal chamber and self-centering around the lance tube.

2. A wall box assembly for a sootblower in accordance with claim 1 wherein the clamping seal assembly restricts leakage of gasses between the interior of the combustion device and the exterior of the combustion device when the clamping seal assembly is in the sealing position.

3. A wall box assembly for a sootblower in accordance with claim 1 wherein the actuator is in the form of a fluid actuated cylinder with a piston coupled with the seal element.

4. A wall box assembly for a sootblower in accordance with claim 3 wherein the clamping seal assembly includes housing and a plurality of the fluid actuated cylinders are mounted to the housing.

5. A wall box assembly for a sootblower in accordance with claim 1 wherein the clamping seal assembly includes a housing having surfaces which restrain the seal elements of a plurality of the seal assemblies to move in a radial direction between the sealing and released positions.

6. A wall box assembly for a sootblower in accordance with claim 1 wherein the actuator is biased by a spring to a cause the seal element to be urged by the spring toward the released position.

7. A wall box assembly for a sootblower in accordance with claim 1 wherein the clamping seal assembly includes at least three of the movable seal assemblies and are oriented such that each of the seal elements are in substantially equal angular arc segments around the outside surface of the lance tube.

8. A wall box assembly for a sootblower in accordance with claim 1 wherein the seal element is retained within a seal shoe which is connected with the actuator.

9. A wall box assembly for a sootblower in accordance with claim 1 wherein the clamping seal assembly having housing and the seal assemblies forming a pair of radial face surfaces and corresponding sealing surfaces of the housing engage with the radial faces.

10. A wall box assembly for a sootblower in accordance with claim 1 wherein the wall box assembly further comprising a secondary seal assembly for sealing with the outside surface of the lance tube.

11. A wall box assembly for a sootblower in accordance with claim 10 wherein the clamping seal assembly and secondary seal assembly are connected together with the lance tube passing through both the seal assemblies with the secondary seal assembly mounted closer to the cleaning port than the clamping seal assembly.

12. A wall box assembly for a sootblower in accordance with claim 1 wherein the seal elements, when in the sealing position, form a generally continuous circumferential seal against the outside of the lance tube.

13. A wall box assembly for a sootblower in accordance with claim 1 wherein the internal chamber is supplied with pressurized fluid and the pistons are exposed to the fluid, such that applying fluid pressure to the internal chamber actuates the seal elements to move to the sealing position, and wherein the jaw plate is self-centered by the fluid pressure within the internal chamber to engage with the lance tube in the sealing piston as the lance tube is positioned in a range of positions relative to the center defined by the annular chamber.

14. A method of sealing a lance tube for cleaning internal surfaces of a combustion device, and wherein a fluid cleaning medium flows through the lance tube during a cleaning cycle and is ejected from the lance tube within the combustion device, the lance tube being retractable into and withdrawn from the combustion device through a cleaning port, the method comprising the steps of:

providing a wall box at the cleaning port having a clamping seal assembly having a plurality of movable seal assemblies, each of the movable seal assemblies having a seal element movable in a radial direction relative to the lance tube through the action of an actuator, the seal element engageable with the outside surface of the lance tube in a sealing position and withdrawable from the outside surface of the lance tube in a released position, the seal element movable between the sealing and retracted positions through the action of the actuator, wherein the plurality of seal assemblies are arranged in a housing with an internal chamber having a cylindrical wall and with a circular jaw plate mounted within the internal chamber with a clearance gap between the jaw plate and the cylindrical wall, each of the plurality of seal assemblies being formed of at least one piston retained by the jaw plate and each piston coupled with one of the seal elements and configured to move the one of the seal elements radially with respect to the jaw plate, and the jaw plate being radially movable within the internal chamber and self-centering around the lance tube, withdrawing the seal elements from contact with the outside of the lance tube during the cleaning cycle by moving the seal elements to the released position, and at the conclusion of the cleaning cycle, actuating the actuator for moving the seal elements into the sealing position in contact with the outside surface of the lance tube.

15. A method of sealing a lance tube for cleaning internal surfaces of a combustion device in accordance with claim 14 further comprising providing a secondary seal assembly having at least one plate having an internal bore which closely conforms with the outside surface of the lance tube and positioning the secondary seal assembly such that the lance tube passes through both the clamping seal assembly and the secondary seal assembly and positioning the secondary seal assembly adjacent the cleaning port with the clamping seal assembly further from the cleaning port.

16. A method of sealing a lance tube for cleaning internal surfaces of a combustion device in accordance with claim 15 wherein the secondary seal assembly defines a longitudinal axis for positioning the lance tube and the clamping seal assembly is provided with means for allowing the seal assemblies to seal with the lance tube with the lance tube positioned at a plurality of displaced radial positions.

* * * * *